US007343870B1

(12) United States Patent
Scholz et al.

(10) Patent No.: US 7,343,870 B1
(45) Date of Patent: Mar. 18, 2008

(54) COMBINATION BOAT HAWSE PIPE AND ACCESSORY TRAY

(75) Inventors: Lenn M. Scholz, Edgewater, FL (US); Harry Wood, Edgewater, FL (US)

(73) Assignee: Boston Whaler, Inc., Edgewater, FL (US)

( * ) Notice: Subject to any disclaimer, the term of this patent is extended or adjusted under 35 U.S.C. 154(b) by 0 days.

(21) Appl. No.: 11/161,329

(22) Filed: Jul. 29, 2005

(51) Int. Cl.
*B63B 17/00* (2006.01)

(52) U.S. Cl. ..... 114/364; 114/179; 114/343; 248/311.2

(58) Field of Classification Search ..... 144/343, 144/210, 364, 179, 180, 181; 248/311.2
See application file for complete search history.

(56) References Cited

U.S. PATENT DOCUMENTS

| | | | | |
|---|---|---|---|---|
| 4,749,162 | A | 6/1988 | Wanzor | |
| 4,919,316 | A | 4/1990 | Grauberger | |
| 5,007,612 | A | 4/1991 | Manfre | |
| 5,113,782 | A * | 5/1992 | McCarty | 114/362 |
| 5,713,546 | A * | 2/1998 | Auspos | 248/156 |
| 6,533,233 | B2 * | 3/2003 | Thomas | 248/311.2 |
| 6,581,538 | B2 | 6/2003 | Sorensen | |

* cited by examiner

*Primary Examiner*—Sherman Basinger
(74) *Attorney, Agent, or Firm*—Matlin, Haley & DiMaggio, P.A.

(57) ABSTRACT

The invention comprises a boat hawse pipe and accessory tray combined in a single-piece unit for mounting on a boat's gunnel boards to provide a means for holding beverage cups, bottles, or personal and marine accessories, and for receiving the dock lines or cables to be tied to cleats on the sidewalls of a boat while preventing damage to the fiberglass body of the boat through frictional contact with those dock lines.

15 Claims, 3 Drawing Sheets

COMBINATION BOAT HAWSE PIPE AND ACCESSORY TRAY

FIELD OF THE INVENTION

This invention relates to an apparatus comprising a combination boat hawse pipe and accessory tray for receiving dock lines, which are passed through the boat hawse pipe aperture to be tied to a boat cleat, and for holding a variety of items, such as beverage cups, bottles, or personal accessories.

DESCRIPTION OF RELATED ART

A boater commonly carries several passengers during a boating excursion and these passengers on the vessel often bring beverage cups and bottles, which require a steady and secure surface for placement when not being held by the user. Due to the movement of boats, a cup holder is required to secure these beverage containers to ensure that the containers, particularly bottles, are not broken or spilled inside of the boat. Moreover, boats require a means for receiving dock lines and cables that are tied and secured to cleats inside the vessel without damaging the fiberglass body of the vessel through frictional contact with those dock lines and cables.

U.S. Pat. No. 5,007,612, issued to Manfre on Apr. 16, 1991, discloses a device which is clamped to a boat's handrail and is utilized to hold food and drinks for fisherman or boater. FIGS. 1 and 2 of the '612 patent disclose a container that accommodates a beverage, as well as an adjacent compartment, which is designed to hold food items, loose accessory items and the like.

U.S. Pat. No. 6,581,538, issued to Sorensen on Jun. 24, 2003, discloses an integrated combination accessory arrangement, particularly for kayaks. With reference to FIG. 1A of the '538 patent, two separate circular voids are adjacent to one another, and are meant to accommodate cylindrical drink holders, cellular phone holders or any other accessory item having a complementary cylindrical shape.

U.S. Pat. Nos. 4,919,316 and 4,749,162, issued respectively to Grauberger on Apr. 24, 1990, and to Wanzor on Jun. 7, 1988, disclose different types of fishing rod holders, which also can accommodate beverage holders and the like. The common concept is that by utilizing either a conventional fishing rod holder or beverage holder, they can likewise receive tubular bodies to support the other product.

SUMMARY OF THE INVENTION

The applicant's invention comprises a single-piece, combined boat hawse pipe and integral accessory tray unit, for receiving dock lines or cables as well as for holding a variety of personal or marine accessories, such as a beverage cup, bottle, or other similarly sized and shaped container as well as fishing lures or hooks. In one embodiment, said boat hawse pipe/accessory tray unit includes a planar top surface, a planar bottom surface, a wider rounded first end, and a narrower, substantially squared second end. The boat hawse pipe/accessory tray unit (hereinafter referred to as the "unit") further includes a circular first aperture penetrating the rounded first end of said unit, which forms the accessory tray portion of said unit. A rectangular second aperture penetrates the second end of the unit, said second aperture being centrally located through said second end of the unit and extending lengthwise across the tapered body of said unit toward the circular first aperture. The second aperture forms the boat hawse pipe portion of said unit for receiving dock lines and cables.

Said unit is substantially planar but includes a rectangular lip that extends downward from the interior edge wall of the second aperture for insertion into the gunnel board of the boat. Upon insertion into the gunnel board, the rectangular lip provides stability to said unit's engagement with said gunnel board. An outer edge of the planar top surface of said unit is beveled so that when engaged with the gunnel board of the boat, the top surface of said unit rises slightly above the surface of the gunnel board. An interior edge wall at the top surface of the first aperture and the interior edge wall of the second aperture are also beveled. The beveled edge wall of the first aperture acts to receive and firmly hold a cup, cup insulator, or other container without allowing said container to pass entirely through said first aperture. The beveled edge wall of said second aperture provides a smooth surface absent of any sharp edges that could cut or fray the dock lines and cables which are passed through said second aperture.

The boat hawse pipe/accessory tray can be of a specific geometry to accommodate a cup or can of conventional dimensions. The unit is tapered, said unit being wider near the first end and becoming narrower toward the second end. The circular first aperture of the unit is sized to prevent a cup, bottle, or other container placed into said first aperture from passing entirely through so that said container is supported securely at the top surface of the gunnel board for easy access by an individual.

Said unit is inserted into and held in place by an aperture precut through the gunnel board. The aperture through said gunnel board is sized and shaped to receive and firmly engage said unit. The unit includes one or more holes for receiving screws to secure said unit to the gunnel board of the boat. Once the unit is mounted within the aperture of the gunnel board, beverage cups, bottles, and other similarly sized and shaped containers may be deposited inside the cup holder formed by the first aperture of said unit. The user may also insert dock lines and cables through the second aperture so that they pass through the gunnel board and can be tied to a cleat mounted beneath the gunnel board to the sidewall of the boat.

The unit, in a preferred embodiment, includes a cup holder or cup insulator, sized and shaped to fit firmly and securely within the circular first aperture of the boat hawse pipe/cup holder unit. Preferably, said cup holder is inserted into and placed within said first aperture so that cups, bottles, and other beverage containers of varying sizes may be accommodated and securely held and supported at the surface of the boat gunnel board on which said unit is mounted. The cup holder is manufactured preferably from plastic or foam although other suitable materials may also be used.

In an alternative embodiment, the unit can be square, rectangular, triangular, or another shape other than circular or cylindrical. Said alternative shapes of the unit may still accommodate holding a cup or bottle while also better accommodating other personal and marine accessories placed into the unit, such as a wallet, sunglasses, bait, lures, fishing hooks and tackle, as well as numerous other small personal items that an individual may wish to store within said unit. The accessory tray is particularly useful for fishermen to hang conventional single hooks and three-pronged hooks on the rim of said accessory tray for easy access.

An object of this invention is to provide a durable combined boat hawse pipe and cup holder unit that can be mounted within the gunnel board of a boat for securely holding beverage cups, bottles, and other containers while also receiving dock lines and cables without cutting or fraying those lines.

Another object of this invention is to provide a combined boat hawse pipe/cup holder unit that receives dock lines and cables to prevent those lines and cables from damaging the fiberglass body of the vessel through frictional contact.

In accordance with these and other objects which will become apparent hereinafter, the instant invention will now be described with particular reference to the accompanying drawings.

DETAILED DESCRIPTION

Figure 1B:
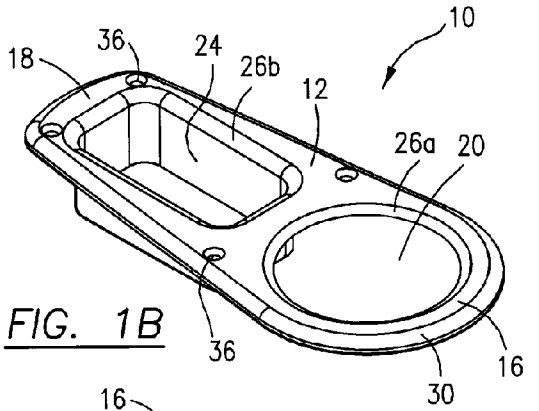
FIG. 1B shows a perspective view of the combination boat hawse pipe/accessory tray unit.
Figure 1D:
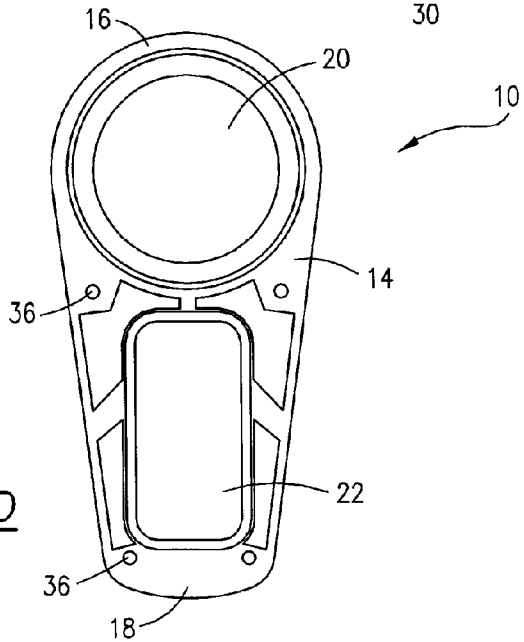
FIG. 1D shows a bottom view of the combination boat hawse pipe/accessory tray unit.

As illustrated in FIGS. 1A through 1D, the invention 10 comprises a single-piece, combined boat hawse pipe and accessory tray unit 10, for receiving dock lines or cables as well as for holding a beverage cup, bottle, cup holder or insulator, or other similarly sized and shaped container. The boat hawse pipe/accessory tray unit 10 is also useful for holding personal and fishing accessories and items, including, but not limited to, wallets, sunglasses, jewelry, food items, bait, lures, fishing hooks, and weights. Said boat hawse pipe/accessory tray unit 10 includes a planar top surface 12, a planar bottom surface 14, a wider rounded first end 16, and a narrower, substantially squared second end 18. Preferably, said boat hawse pipe/accessory tray unit 10 is manufactured from stainless steel. The boat hawse pipe/accessory tray unit 10 (hereinafter referred to as the "unit") further includes a circular first aperture 20 penetrating the rounded first end 16 of said unit 10, said first aperture 20 being centrally located through said first end 16 of said unit 10. The circular first aperture 20 forms the accessory tray portion of said unit 10. Although the accessory tray portion of said unit 10 is preferably circular or cylindrical in shape, said accessory tray portion, and thus, the first aperture 20, may also be rectangular, triangular, or any other shape that will accommodate beverage containers as well as personal and fishing items and accessories. A substantially rectangular second aperture 22 penetrates the squared second end 18 of the unit 10, said second aperture 22 being centrally located through said second end 18 of the unit 10 and extending lengthwise across the tapered body of said unit 10 toward the circular first aperture 20. The rectangular second aperture 22 forms the boat hawse pipe portion of said unit 10 for receiving dock lines and cables.

Said unit 10 is substantially planar but includes a rectangular lip 24 that extends downward from an interior edge wall 26*b* of the rectangular second aperture 22 at the bottom surface 14 of said unit 10 for insertion into a gunnel board 28 of the boat, thereby providing stability to said unit's engagement with said gunnel board. An outer edge 30 of the planar top surface 12 of said unit 10 is beveled so that when engaged with the gunnel board 28 of the boat, said beveled outer edge 30 rests upon the top surface of the gunnel board 28. Thus, the top surface 12 of the unit 10 rises slightly above the top surface of the gunnel board 28 when engaged with said gunnel board 28. An interior edge wall 26*a* at the top surface 12 of the first aperture 20 and the interior edge wall 26*b* of the second aperture 22 are beveled downward and inward toward the center of each aperture 20 and 22. The beveled edge wall 26*a* of the first aperture 20 acts to receive and firmly hold a cup, a cup holder or insulator 32, or other container without allowing said container to pass entirely through said first aperture 20. The beveled edge wall 26*b* of said second aperture 22 provides a smooth surface absent of any sharp or rough edges that could cut or fray the dock lines and cables which are passed through said second aperture 22.

Figure 1A:
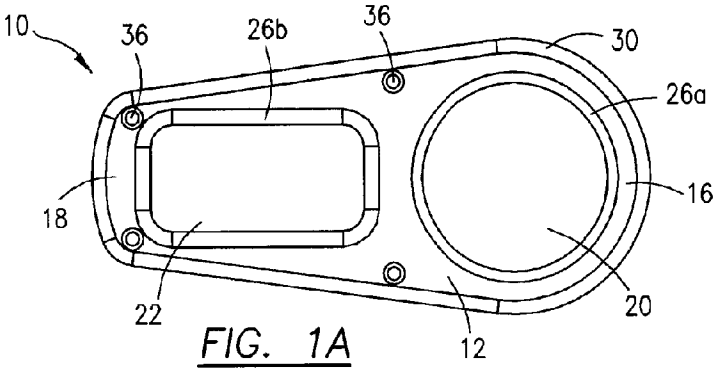
FIG. 1A shows a top view of the combination boat hawse pipe/accessory tray unit.
Figure 1C:
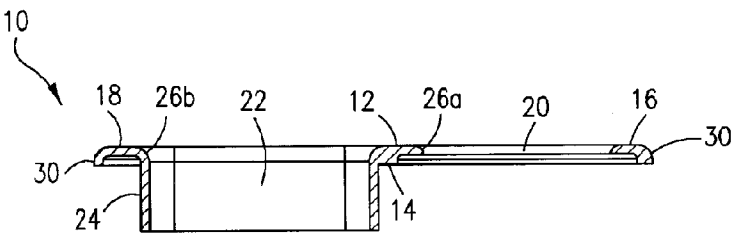
FIG. 1C shows a left side view of the combination boat hawse pipe/accessory tray unit, where a right side view would be a mirror-image of said left side view.

As shown in FIGS. 1A and 1B, said planar boat hawse pipe/accessory tray unit 10 is tapered, said unit 10 being wider near the rounded first end 16 and becoming narrower toward the squared second end 18 of said unit 10. The circular first aperture 20 of the unit 10 can be sized to prevent a cup, bottle, or other container placed into said first aperture from passing entirely through so that said container is supported at the top surface of the gunnel board 28 for easy access by an individual.

Figure 2A:
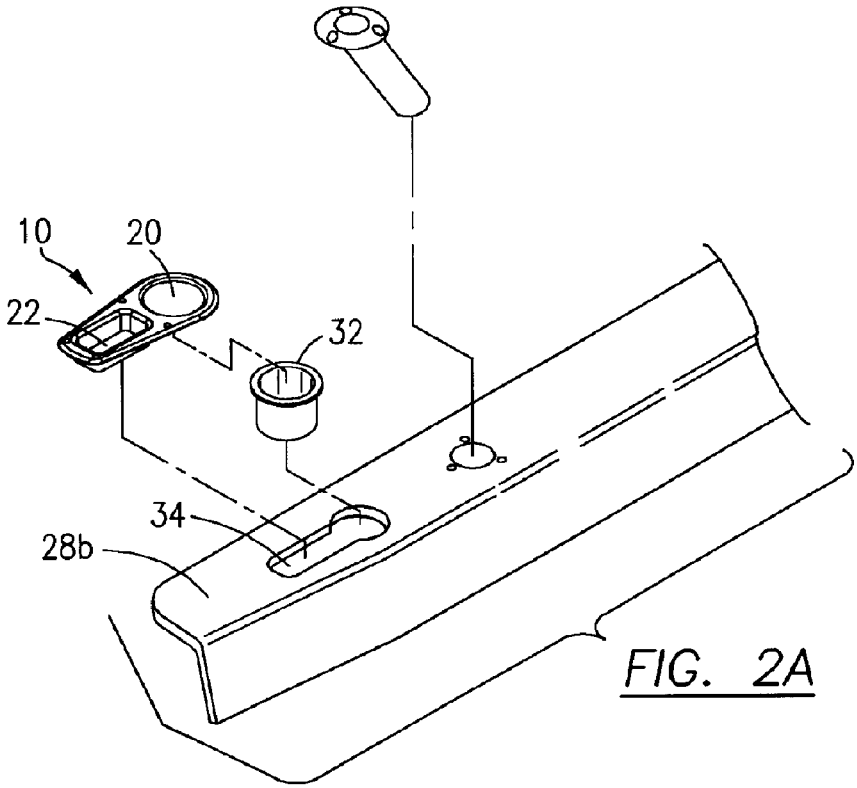
FIG. 2A shows an exploded perspective view of the combination boat hawse pipe/accessory tray unit, a rod holder, and a cut-away view of a port gunnel board.
Figure 2B:
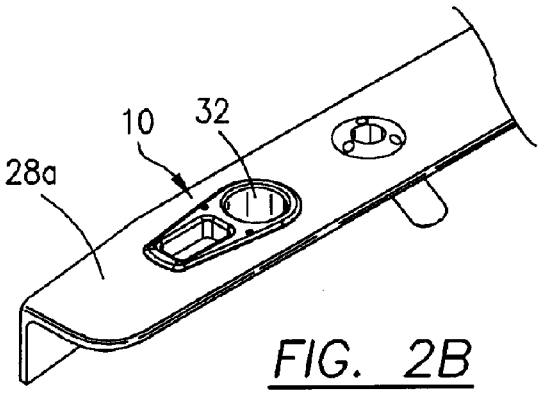
FIG. 2B shows an exploded perspective view of the combination boat hawse pipe/accessory tray unit, a rod holder, and a cut-away view of a starboard gunnel board.
Figure 3:
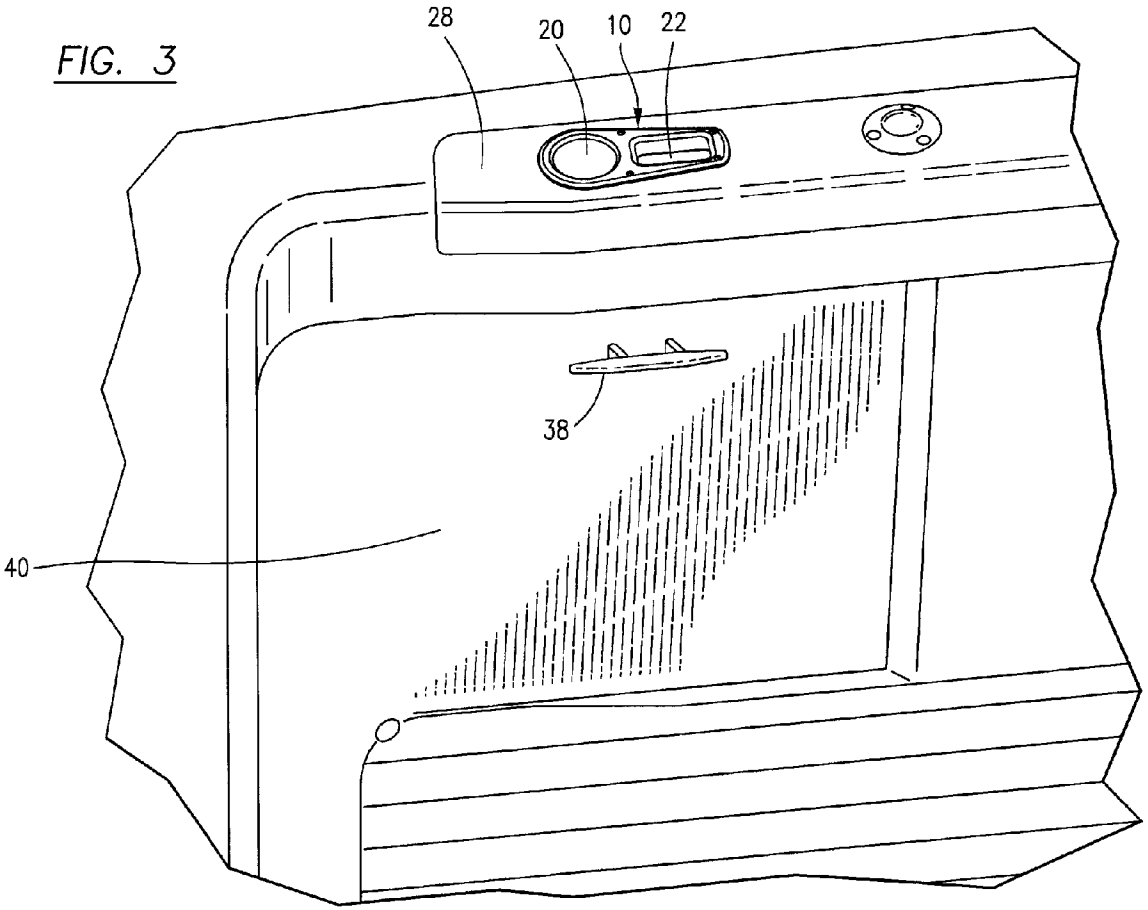
FIG. 3 shows a perspective cut-away view of the combination boat hawse pipe/accessory tray unit, a rod holder, a port gunnel board, and portions of the boat sidewall, transom, and deck floor.

As illustrated in FIGS. 2A, 2B, and 3, said unit 10 is inserted into and held in place by an aperture 34 precut through each of the starboard and port gunnel boards, 28*a* and 28*b* respectively, of a vessel. The apertures 34 through said gunnel boards 28*a* and 28*b* are sized and shaped to receive and firmly engage said boat hawse pipe/accessory tray unit 10. Said unit 10 includes one or more, but preferably four, holes 36 for receiving a plurality of screws or rivets (not shown in the drawings) to secure said unit 10 to the gunnel board 28 of the boat. Once the unit 10 is mounted within the surface aperture 34 of the gunnel board 28, beverage cups, bottles, and other similarly sized and shaped containers may be deposited and supported inside the first aperture 20 of said unit 10. Said cup or other container is supported by the unit 10 at the surface of the gunnel board 28 for easy access by the user. The user may also insert dock lines and cables through the second aperture 22 so that said dock lines and cables pass through the gunnel board 28 and can be tied and secured to a boat cleat 38 mounted beneath the gunnel board 28 to the sidewall 40 of the boat, as shown in FIG. 3. The beveled interior edge wall 26*b* of the second aperture 22 of said unit 10, which is preferably constructed from stainless steel, is contacted by the dock lines and cables, thereby preventing said lines and cables from damaging the fiberglass body of the boat through frictional contact.

As shown in FIG. 2A, said unit 10 preferably includes a cup holder 32 or cup insulator 32, which is sized and shaped to fit firmly and securely within the circular first aperture 20 of the boat hawse pipe/accessory tray unit 10. Preferably, said cup holder 32 is inserted into and placed within said first aperture 20 so that cups, bottles, and other containers of varying sizes as well as personal and fishing items and accessories may be accommodated and securely held and supported at the surface of the boat gunnel board 28 on which said unit 10 is mounted. The cup holder 32 is manufactured preferably from plastic or foam although other suitable materials may also be used. Said cup holder 32 provides the cup, bottle, or other item a cushion against jarring effects while the boat is moving so that said container is not jolted roughly against the stainless steel interior edge wall 26*b* of said unit 10. The cup holder 32 may be in the form of a cup insulator 32 constructed from foam or some other insulating material useful for keeping a beverage or food cool or for maintaining the warmth of a hot beverage or food material. Said cup holder 32 can be manufactured to any desired depth or diameter and is preferably cylindrical in shape.

The invention 10 can be used to hold cups, bottles, or other containers of food, beverages, bait, or any other substance or material stored within a cup, bottle, or other container. The invention 10 can also be used to hold and support personal and fishing items and accessories such as wallets, jewelry, sunglasses, lures, hooks, and weights. The accessory tray portion of the unit 10 is particularly useful to fishermen for hanging single or three-pronged hooks around the lip of the first aperture 20 of said unit 10.

In an alternate embodiment of the invention, said boat hawse pipe/accessory tray unit 10 further includes a third aperture sized and shaped for receiving and securely holding in a substantially vertical position, a fishing rod that is inserted into said third aperture. The aperture 34 through the gunnel board 28 of the boat must be sized and shaped appropriately to accommodate the additional third aperture that is included in this particular embodiment of the invention.

The instant invention has been shown and described herein in what is considered to be the most practical and preferred embodiment. The applicant recognizes, however, that departures may be made therefrom within the scope of the invention and that obvious modifications will occur to a person skilled in the art.

What is claimed is:

1. An apparatus comprising an integrated, unitary, combination boat hawse pipe and accessory tray unit, said unit including:

a boat hawse pipe portion having an aperture for receiving and permitting the passage of dock lines or cables through said boat hawse pipe portion and through a gunnel of a boat;

wherein said boat hawse pipe/accessory tray unit is substantially planar but includes a rectangular lip that encircles and extends downward from an interior edge wall of a rectangular second aperture at a bottom surface of the unit for insertion into the gunnel board of the boat, thereby providing stability to said unit's engagement with said gunnel board; and an accessory tray portion of said unit for holding a beverage cup, bottle, or personal or marine accessories, including, but not limited to, bait, lures, fishing hooks, sunglasses, jewelry, or a wallet.

2. The apparatus of claim 1, wherein said boat hawse pipe/accessory tray unit is manufactured from stainless steel.

3. The apparatus of claim 1, wherein said boat hawse pipe/accessory tray unit is inserted into and held in place by apertures precut through a starboard gunnel board and a port gunnel board of a vessel, said apertures through said gunnel boards being sized and shaped to receive and firmly engage said boat hawse pipe/accessory tray unit.

4. The apparatus of claim 1, wherein said boat hawse pipe/accessory tray unit comprises:

a planar top surface;

a planar bottom surface;

a wider rounded first end;

a narrower, substantially squared second end;

a circular first aperture penetrating the rounded first end, said first aperture being centrally located through said first end of the boat hawse pipe/accessory tray unit; and a substantially rectangular second aperture penetrating the squared second end of said boat hawse pipe/accessory tray unit, said second aperture being centrally located through said second end of the boat hawse pipe/accessory tray unit and extending lengthwise across the tapered body of said unit toward the circular first aperture.

5. The apparatus of claim 4, wherein an interior edge wall at the top surface of the first aperture is beveled downward and inward toward the center of said circular first aperture so as to receive and firmly hold a cup, bottle, cup holder or insulator, or personal or fishing accessories without allowing said container or other item to pass entirely through said first aperture.

6. The apparatus of claim 5, wherein the circular first aperture is sized to prevent a cup, bottle, or personal or fishing accessories placed into said first aperture from passing entirely through so that said container or item is held and supported at the top surface of the gunnel board for easy access by an individual.

7. The apparatus of claim 5, wherein preferably a cup holder or cup insulator, sized and shaped to fit firmly and securely within the circular first aperture of the boat hawse pipe/accessory tray unit, is inserted into and placed within said first aperture so that cups, bottles, and other containers and/or accessories or materials of varying sizes and shapes may be accommodated and securely held and supported at the top surface of the boat gunnel board on which said unit is mounted.

8. The apparatus of claim 1, wherein said boat hawse pipe/accessory tray unit includes one or more holes for receiving a plurality of screws or rivets to secure said unit to the gunnel board of the boat.

9. The apparatus of claim 1, wherein an outer edge of the planar top surface of said boat hawse pipe/accessory tray unit is beveled.

10. The apparatus of claim 1, wherein the interior edge wall at the top surface of the second aperture is beveled downward and inward toward a center of said second aperture so as to provide a smooth surface absent any sharp or rough edges that could cut or fray dock lines and cables which are passed through said second aperture.

11. The apparatus of claim 1, wherein said planar boat hawse pipe/accessory tray unit is tapered lengthwise, said unit being wider near a rounded first end of said unit and becoming narrower toward a squared second end of the unit.

12. An apparatus for receiving dock lines or cables as well as for holding a beverage cup, bottle, or personal or fishing accessories, comprising:

a single-piece, combined boat hawse pipe and accessory tray unit having:

a planar top surface having an outer edge that is beveled;

a planar bottom surface;

a wider rounded first end;

a narrower, substantially squared second end;

a circular first aperture penetrating the rounded first end, said first aperture being centrally located on and passing through said first end of the boat hawse pipe/accessory tray unit;

wherein an interior edge wall at the top surface of the first aperture is beveled downward and inward toward the center of said first aperture so as to receive and firmly hold a cup or other container without allowing said container to pass entirely through said first aperture;

a substantially rectangular second aperture penetrating the squared second end of said boat hawse pipe/accessory tray unit, said second aperture being centrally located on and passing through said second end of the boat hawse pipe/accessory tray unit and extending lengthwise across said unit toward the circular first aperture;

wherein an interior edge wall at the top surface of the second aperture is beveled downward and inward toward the center of said second aperture so as to provide a smooth surface absent of any sharp or rough edges that could cut or fray the dock lines and cables which are passed through said second aperture;

a rectangular lip that encircles and extends downward from the interior edge wall of the rectangular second aperture at the bottom surface of the unit for insertion into the gunnel board of the boat, thereby providing stability to said unit's engagement with said gunnel board; and one or more holes passing entirely through the top and bottom surfaces of said unit for receiving a plurality of screws or rivets to secure said unit to the gunnel board of the boat; and wherein said unit is tapered so that the unit is wider near the rounded first end of said unit and becomes narrower toward the squared second end of the unit; and a cup holder or cup insulator constructed preferably from plastic or foam and sized and shaped to fit firmly and securely within the circular first aperture of the boat hawse pipe/accessory tray unit, said cup holder being inserted into and placed within said first aperture so that cups, bottles, and other containers and materials of varying sizes and shapes may be accommodated, and said cup holder being sized and shaped to prevent said cup, bottle, or other container or material placed into said cup holder from passing entirely through so that said container or material is held and supported securely at the surface of the gunnel board on which said unit is mounted for easy access by an individual.

13. The apparatus of claim 12, wherein said boat hawse pipe/accessory tray unit is inserted into and held in place by apertures through each of a starboard gunnel board and a port gunnel board of a vessel, said apertures through said gunnel boards being sized and shaped to receive and firmly engage said boat hawse pipe/accessory tray unit.

14. The apparatus of claim 1, wherein the accessory tray portion of said unit is constructed in a shape selected from one or more of the following shapes: circular, cylindrical, rectangular, triangular, or another shape;

wherein said shape in which said accessory tray portion is constructed accommodates both beverage containers as well as personal and fishing items and accessories.

15. The apparatus of claim 1, wherein said boat hawse pipe/accessory tray unit includes four holes for receiving a plurality of screws or rivets to secure said unit to the gunnel board of the boat.

* * * * *